United States Patent [19]

Pearson

[11] 4,194,674

[45] Mar. 25, 1980

[54] CONTAINER WITH BUILT IN STRAW

[76] Inventor: Kenneth Pearson, RD 3, Box 241-A, Tyrone, Pa. 16686

[21] Appl. No.: 941,492

[22] Filed: Sep. 11, 1978

[51] Int. Cl.[2] ..... B65D 77/28

[52] U.S. Cl. ..... 229/7 S; 215/229; 215/1 A

[58] Field of Search ..... 215/1 A, 229; 229/7 S

[56] References Cited

U.S. PATENT DOCUMENTS

| | | | |
|---|---|---|---|
| 3,071,303 | 1/1963 | Pugh | 229/7 S |
| 3,303,984 | 2/1967 | Jurena | 229/7 S |
| 3,486,679 | 12/1969 | Pfahler | 229/7 S |
| 3,568,870 | 3/1971 | Elston | 215/1 A |
| 3,717,476 | 2/1973 | Harvey | 229/7 S |
| 3,746,197 | 7/1973 | Sather | 215/1 A |
| 3,946,895 | 3/1976 | Pugh | 229/7 S |
| 4,078,692 | 3/1978 | Stein | 215/1 A |

FOREIGN PATENT DOCUMENTS

| | | | |
|---|---|---|---|
| 753099 | 2/1967 | Canada | 229/7 S |
| 253678 | 2/1976 | Fed. Rep. of Germany | 215/229 |
| 1091935 | 4/1955 | France | 215/1 A |

*Primary Examiner*—Donald F. Norton
*Attorney, Agent, or Firm*—Howard I. Podell

[57] ABSTRACT

A drinking straw formed with a flexible corrugated intermediate section is fixed to a flat flexible tab adjacent the intermediate section, which tab may be bonded between the sealing flaps of a paper container with the straw held inside the container. Alternatively, the tab may be fixed between a seal disc and a closure cap of a bottle or can so that the straw may be suspended, in folded array inside of the bottle or can prior to use.

3 Claims, 8 Drawing Figures

CONTAINER WITH BUILT IN STRAW

BACKGROUND OF THE INVENTION

Containers containing built in straws are taught in U.S. Pat. Nos. 3,874,554; 3,071,303; 3,325,076; 3,303,985; 3,397,830; 3,462,061; 3,559,868; 3,486,679; and 3,545,604. However, in none of these devices is the straw formed with a flexible corrugated section and supported by a strip of adhesive coated paper, that is both sealed to the straw and bonded to sealed flaps of the carton.

SUMMARY OF THE INVENTION

This invention is directed towards a straw adaptable for being fitted inside a container prior to use for convenience in drinking the contents of the container. The container may be of a more or less conventional cardboard type, wherein the top flaps are sealed together in an elongated seal, and one of the flaps can be folded out to form a spout which allows access to the contents of the container or alternatively the container may be in the form of a bottle or can closed by a circular cap.

In this invention, a folded straw is fastened to a tab of paper, which tab is suspended from a sealed top flap of the carton. When the front flap is folded out, the top end of the straw pops out of the carton, with the lower end of the straw held in position by the paper strip so as to reach the bottom of the carton. Alternatively, the tab of the straw may be fastened between the inner face of a bottle cap and a circular sealing disc fastened against the inner face of the bottle cap, with the straw folded inside the bottle, when the cap is removed from the bottle, the straw is pulled out and may then be detached from the cap, if desired.

DETAILED DESCRIPTION OF PREFERRED EMBODIMENTS

Figure 1:
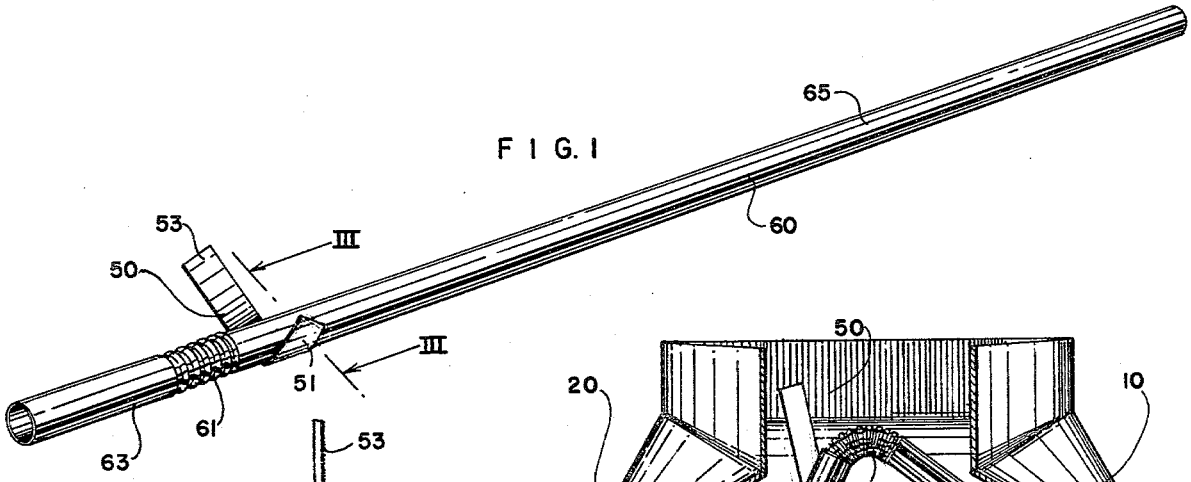
FIG. 1 is a drawing of the straw of the invention.
Figure 3:
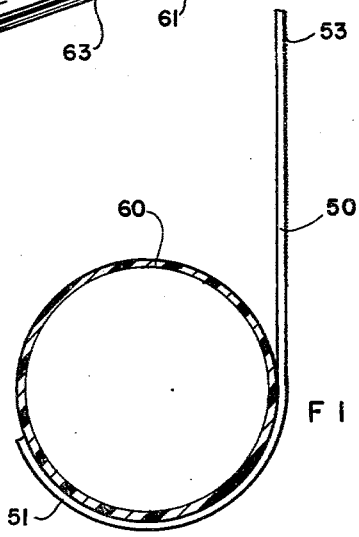
FIG. 3 is a view along line III—III of FIG. 1.

A carton 15 of wax, impregnated paper, or other conventional substance is generally cubical in shape with an upwardly and inwardly sloping roof 12. This roof has an upwardly and rearwardly extending front flap 10, an upwardly and forwardly extending rear flap 20, and two upwardly and inwardly extending side flaps 30. The flaps are all sealed together in an elongated, central, forwardly extending seal 40.

A tubular resillient straw 60 is made of plastic and formed with an intermediate flexible corrugated section 61, with corrugated section 61 joined to an upper straight length 63 and a lower straight length 65, with the upper length preferably shorter then the lower length.

Figure 2:
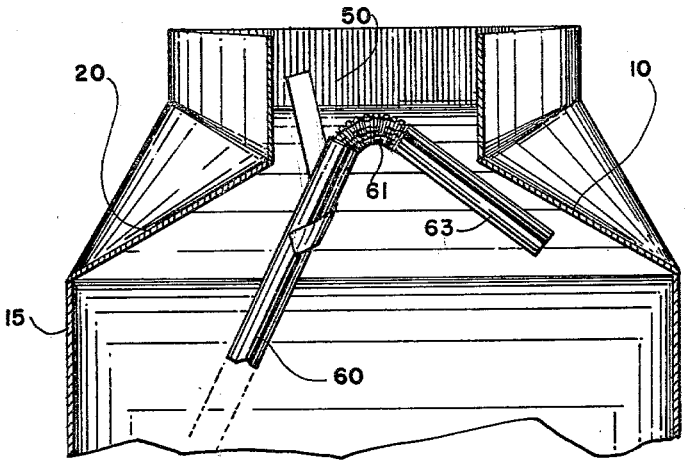
FIG. 2 is a detailed view of the interior of the carton fitted with the invention in the sealed carton mode.
Figure 4:
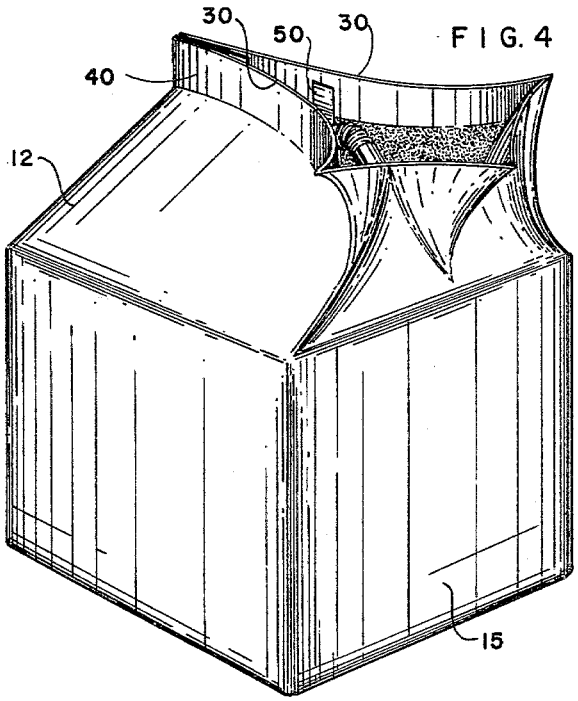
FIG. 4 is a perspective view of the opened carton.
Figure 5:
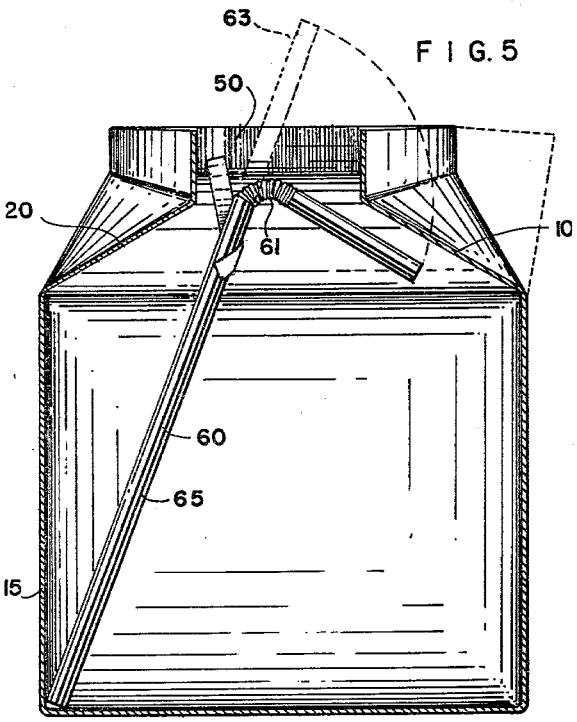
FIG. 5 is a view of the interior of the straw and carton of the invention.

A flat strip of flexible material in the form of tab 50 is bonded or otherwise fastened, at one end 51 to straw 60 adjacent flexible straw section 61, with tab 50 extending at an acute angle to the straw as seen from the flexible section 61 of the straw so that, as shown in FIGS. 2 and 5, in a container 15 the end section 53 of tab 50 may extend vertically upwards from straw 60 inside of container 15, with the straw 60 bent about flexible section 61 so that the lower length 65 extends to the bottom of the container 15 and the upper length 63 also extends downwards under the sealed flaps 10 of container 15 and with straw 60 suspended in place by tab 50, the end section 53 of which is bonded between the sealed side flaps 30 of the container.

When the front flap 10 is pulled forwardly, as is conventional practice in opening this sort of container 15, the upper portion 63 of the straw which is forward of the tab pops up behind the spout thus created, allowing access to the contents of the container, as shown in FIG. 5.

Figure 6:
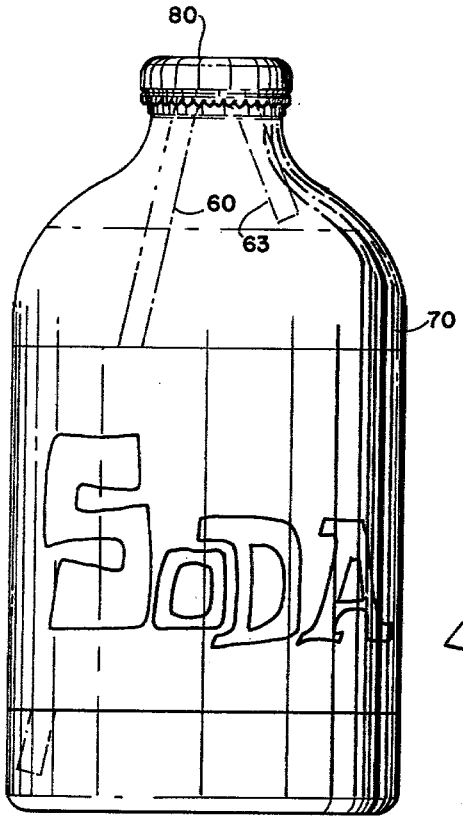
FIG. 6 is a view of the straw of the invention fastened in a bottle.
Figure 7:
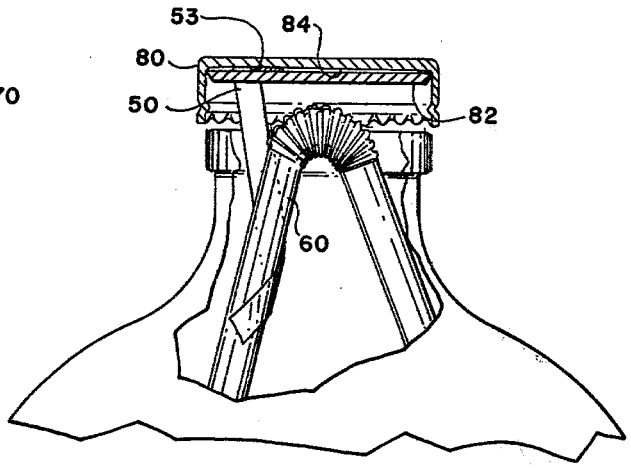
FIG. 7 is a sectional detail view of the cap and straw of the bottle of FIG. 6.
Figure 8:
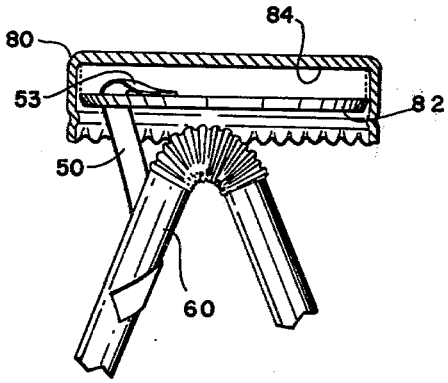
FIG. 8 is an exploded detail view of the cap and stray of FIG. 7.

FIGS. 6–8 illustrate the straw 60 employed in a beverage bottle 70 or can which is sealed, prior to use, by a detachable circular cap 80.

Cap 80 is fitted with a circular sealing disc 82 which is frictionally pressed against the undersurface 84 of cap 80 so that disc 82 seals against the rim of bottle 70 when the bottle is capped with cap 80. Straw 60 is bent inside the interior of bottle 70 and held in place by tab 50, the end section 53 of which is frictionally held in place between disc 82 and undersurface 84 of cap 80.

When cap 80 is removed in conventional manner, shorter upper section 63 of straw 60 is pulled free of bottle 70, with the lower section 65 remaining in the bottle.

Cap 80 may then be separated, if desired, from tab 50 after cap 80 is removed from the bottle by pulling tab 50 free of engagement between disc 82 and cap 80, or tab 50 may be formed with a tear line so that it may be torn to separate the end section 53 from the end section 51 attached to the straw.

Bottle 70 may be formed of semi-rigid material such as glass or metal, or may be of non-circular cross-section such as a rectangular shaped can.

Having thus described the invention, what I claim as new and desire to secure by Letters Patent of the United States is:

1. A straw adaptable for being fastened inside a closed beverage container where said container is fitted with openable means to seal said container;

said straw formed of a substantially hollow tubular shape and formed with an intermediate flexible section;

a flat strip of flexible material in the form of a tab fixed at a first end of the tab to the straw adjacent said intermediate flexible section such that the second end of the said tab may be fastened to the said openable means to seal said container so as to suspend the straw inside the container and folded about the said intermediate section, in which the said intermediate flexible section is of corrugated construction, and in which the tab is fastened to the straw so as to extend at an acute angle towards the intermediate section, in which the beverage container is of folded paper construction and in which the openable means to seal the container are in the form of flaps, and in which the said straw is folded about said corrugated section inside the container with relation to said flaps, and freely suspended by said tab such that opening of the flaps of the openable means of the container causes a first end section of the straw to freely pop out of the opened opening of the container.

2. The straw of claim 1 in which the straw is mounted by the tab to the openable means so as to remain fixed to the said openable means in the open position of the openable means so as to support said straw, with the first end section popped out of the container and a second end section of the straw supported in the interior of the container, by the tab to which it is fixed.

3. A straw adaptable for being fastened inside a beverage container in the form of a bottle, where said container is fitted with a removable cap means detachably fitted about an opening of the container so as to seal said opening and said container, said straw formed of a substantially hollow tubular shape and formed with a intermediate flexible corrugated section, with a flat strip of flexible material in the form of a tab, a first end of which is fixed to the straw externally adjacent said intermediate section with the second end of said tab fastened to an underside of the cap means, so as to suspend said straw inside the container with the straw folded about the said intermediate section when the cap means is fitted about the container opening, such that removal of the cap means from the container opening serves to lift the intermediate section of the straw, by the tab, out of the container.

* * * * *